US010813509B2

(12) United States Patent
Deleon

(10) Patent No.: US 10,813,509 B2
(45) Date of Patent: Oct. 27, 2020

(54) CONTROLLED MOISTURE WET WIPE ROLL DEVICE

(71) Applicant: Lussy Deleon, Medford, NY (US)

(72) Inventor: Lussy Deleon, Medford, NY (US)

( * ) Notice: Subject to any disclaimer, the term of this patent is extended or adjusted under 35 U.S.C. 154(b) by 146 days.

(21) Appl. No.: 16/250,037

(22) Filed: Jan. 17, 2019

(65) Prior Publication Data

US 2020/0229658 A1 Jul. 23, 2020

(51) Int. Cl.
*A47K 10/32* (2006.01)

(52) U.S. Cl.
CPC ..... *A47K 10/32* (2013.01); *A47K 2010/3266* (2013.01)

(58) Field of Classification Search
CPC ..... A47K 10/32; A47K 2010/3266
See application file for complete search history.

(56) References Cited

U.S. PATENT DOCUMENTS 187,604 A * 2/1877 Dempster ..... B65H 35/0026 242/588.6
2,806,738 A * 9/1957 Tsakalas ..... A47K 10/32 239/52
3,310,353 A * 3/1967 Cordis ..... A47K 10/32 312/34.4
3,592,161 A * 7/1971 Hoffmann ..... A47K 10/38 118/122
3,775,801 A * 12/1973 Walker ..... A47K 10/3827 15/104.93
3,837,595 A * 9/1974 Boone ..... A47K 10/32 242/594.5
3,848,822 A * 11/1974 Boone ..... A47K 10/40 242/590
4,590,089 A * 5/1986 Cartmell ..... A61B 5/04026 417/2
5,439,521 A * 8/1995 Rao ..... A47K 10/3827 118/415
5,598,987 A * 2/1997 Wachowicz ..... B65H 35/0006 242/597.8
5,660,313 A * 8/1997 Newbold ..... A47K 10/32 206/205
5,680,978 A * 10/1997 Pinion ..... B65D 85/672 220/230
5,765,717 A * 6/1998 Gottselig ..... A47K 10/32 206/233

(Continued)

*Primary Examiner* — William A. Rivera
(74) *Attorney, Agent, or Firm* — Lyman Moulton, Esq.; Moulton Patents PLLC

(57) ABSTRACT

A wet wipe device is disclosed to include a water tight outer shell that includes two endcaps, at least one moisture inlet and an overlapping longitudinal paper egress defined in the outer shell. A hollow tube disposed radially within the outer shell, the hollow tube configured to enable the roll of paper to rotate thereon while the outer shell is stationary. The overlapping longitudinal paper egress includes a first edge having a first radius and a second edge having a radius less than the first radius to form an overlapping seal around the paper egress. The at least one moisture inlet includes one moisture inlet for a toilet paper roll shell and at least two moisture inlets for a paper towel shell. The toilet paper or paper towel may be premoistened and premedicated or moistened in use and be perforated or cut to length via a disclosed strip paper cutter.

20 Claims, 4 Drawing Sheets

(56) References Cited

U.S. PATENT DOCUMENTS

| | | | | |
|---|---|---|---|---|
| 6,056,235 | A * | 5/2000 | Brozinsky | A47K 10/32 242/598.6 |
| 6,626,395 | B1 * | 9/2003 | Newman | A47K 10/32 242/598.6 |
| 6,745,975 | B2 * | 6/2004 | Faulks | A47K 10/32 242/598.6 |
| 7,395,986 | B1 * | 7/2008 | Haering | A47K 10/405 242/598.6 |
| 8,800,910 | B2 * | 8/2014 | Shepherd | B65H 35/10 242/597.8 |
| 9,538,885 | B2 * | 1/2017 | Cojocaru | B65D 85/672 |
| 9,579,000 | B1 * | 2/2017 | Morris | A47K 10/38 |
| 2002/0096596 | A1 * | 7/2002 | Adelakun | A47K 10/38 242/570 |
| 2002/0190154 | A1 * | 12/2002 | Newman | A47K 10/32 242/598.6 |
| 2007/0175914 | A1 * | 8/2007 | Warke | B65D 83/0805 221/45 |
| 2007/0221778 | A1 * | 9/2007 | Gullo | A47K 10/3827 242/598.6 |
| 2013/0075416 | A1 * | 3/2013 | Boyce | A47K 10/38 221/34 |
| 2013/0126665 | A1 * | 5/2013 | Fournier | A47K 10/40 242/598.6 |
| 2014/0263816 | A1 * | 9/2014 | Derwenskus | A47K 10/38 242/598.6 |
| 2014/0291439 | A1 * | 10/2014 | Winestock | A47K 10/38 242/588.3 |

* cited by examiner

CONTROLLED MOISTURE WET WIPE ROLL DEVICE

BACKGROUND OF THE INVENTION

Since the mid-2000s, wet wipes such as baby wipes have become more common for use as an alternative to toilet paper in affluent countries, including the United States and the United Kingdom. This usage has in some cases been encouraged by manufacturers, who have labelled some wet wipe brands as "flushable". Wet wipes, even "flushable" ones, when flushed down the toilet, have been known to clog internal plumbing, septic systems, and public sewer systems. The tendency for fat and wet wipes to cling together encourages the growth of the problematic obstructions in sewers known as 'fatbergs'. In addition, some brands of wipes contain alcohol, which can kill the bacteria and enzymes responsible for breaking down solid waste in septic tanks. In the late 2010s, alternatives such as the gel wipe came to market to relieve pressure on sewage systems and marine life.

Toilet Paper is a tissue paper product people primarily use to clean up after of fecal defecation and to clean the perineal area of urine after urination and other bodily fluid releases. It also acts as a layer of protection for the hands during these processes. It is sold as a long strip of perforated paper wrapped around a paperboard core for storage in a dispenser near a toilet. Most modern toilet paper in the developed world is designed to decompose in septic tanks, whereas some other bathroom and facial tissues are not. Toilet paper comes in various numbers of plies (layers of thickness), from one-ply all the way up to six-ply, with more back-to-back plies granting greater strength and absorbency.

The use of paper for hygiene has been recorded in China in the 6th century AD, with specifically manufactured toilet paper being mass-produced in the 14th century. Modern commercial toilet paper originated in the 19th century, with a patent for roll-based dispensers being made in 1883.

There is therefore a long felt need in the market for a modern spin on toilet paper and other bathroom and kitchen paper.

SUMMARY OF THE INVENTION

A wet wipe device is disclosed to include a water tight outer shell. The shell includes two endcaps, at least one moisture inlet and an overlapping longitudinal paper egress defined in the outer shell. The device also includes a hollow tube disposed radially within the outer shell, the hollow tube configured to enable the roll of paper to rotate thereon while the outer shell is stationary. The overlapping longitudinal paper egress includes a first edge having a first radius and a second edge having a radius less than the first radius to form an overlapping seal around the paper egress. The at least one moisture inlet includes one moisture inlet for a toilet paper roll shell and at least two moisture inlets for a paper towel shell.

A wet wipe system as disclosed, includes a continuous roll of paper, a water tight outer shell enclosing the roll of paper and comprising two endcaps, at least one moisture inlet and an overlapping longitudinal paper egress defined in the outer shell. A hollow tube is disposed radially within the outer shell. The hollow tube is configured to enable the continuous roll of paper to rotate thereon while the outer shell is stationary.

A wet wipe method disclosed includes providing a roll of paper; inserting the roll of paper inside a water tight outer shell comprising two endcaps, at least one moisture inlet and an overlapping longitudinal paper egress defined in the outer shell; and rotating the roll of paper on a hollow tube disposed radially within the outer shell, the hollow tube configured to enable the roll of paper to rotate thereon while the outer shell is stationary. The wet wipe method disclosed further includes moisturizing the roll of paper to a predetermined moisture amount via inserting an amount of liquid through the moisture inlet.

Other aspects and advantages of embodiments of the disclosure will become apparent from the following detailed description, taken in conjunction with the accompanying drawings, illustrated by way of example of the principles of the disclosure herein.

Figure 1:
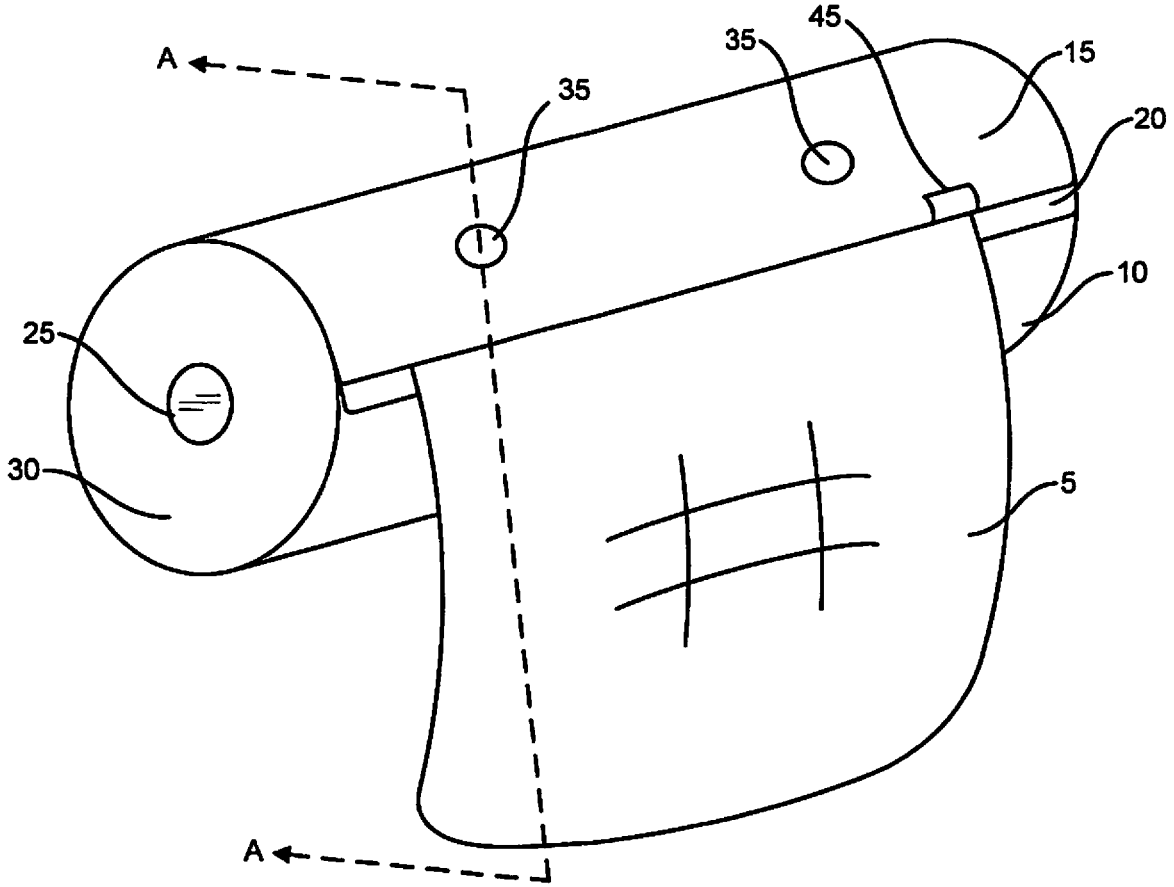
FIG. 1 is an outside perspective view of a controlled moisture wet wipe paper towel roll device in accordance with an embodiment of the present disclosure.

Throughout the description, similar and same reference numbers may be used to identify similar and same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to a person of ordinary skill in the relevant art and having possession of this disclosure, are to be considered within the scope of the invention.

FIG. 1 is an outside perspective view of a controlled moisture wet wipe paper towel roll device in accordance with an embodiment of the present disclosure. The figure includes a paper roll, continuous or perforated, a bottom wall 10 the shell 15, a paper egress 20, a hollow tube 25, an endcap 30, a moisture inlet 35 and a track paper cutter 45.

Figure 2:
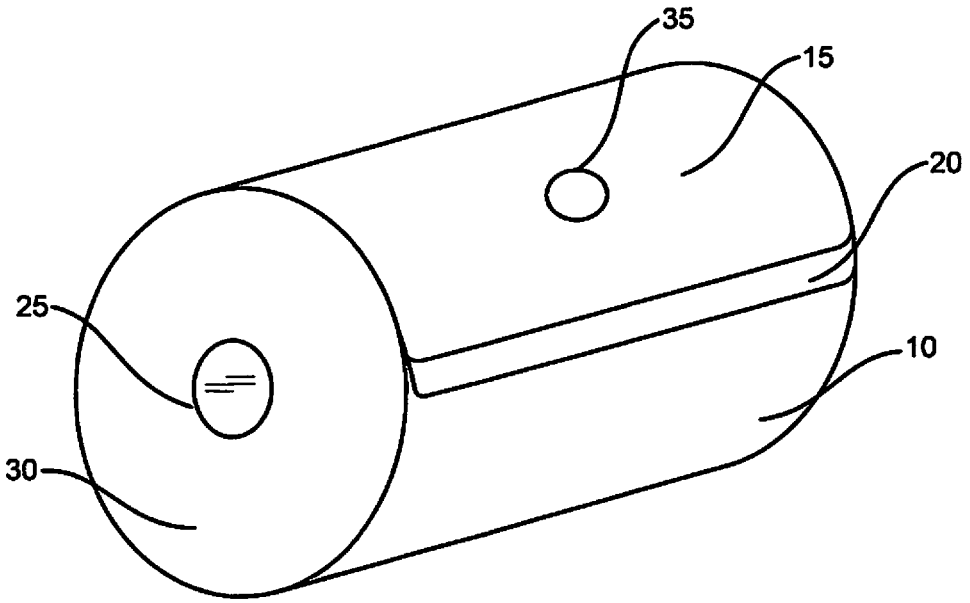
FIG. 2 is an outside perspective view of a controlled moisture wet wipe toilet paper roll device in accordance with an embodiment of the present disclosure.

FIG. 2 is an outside perspective view of a controlled moisture wet wipe toilet paper roll device in accordance with an embodiment of the present disclosure. Similar reference numbers are used for similar features as illustrated in FIG. 1 only for a shorter toilet paper roll.

Figure 3:
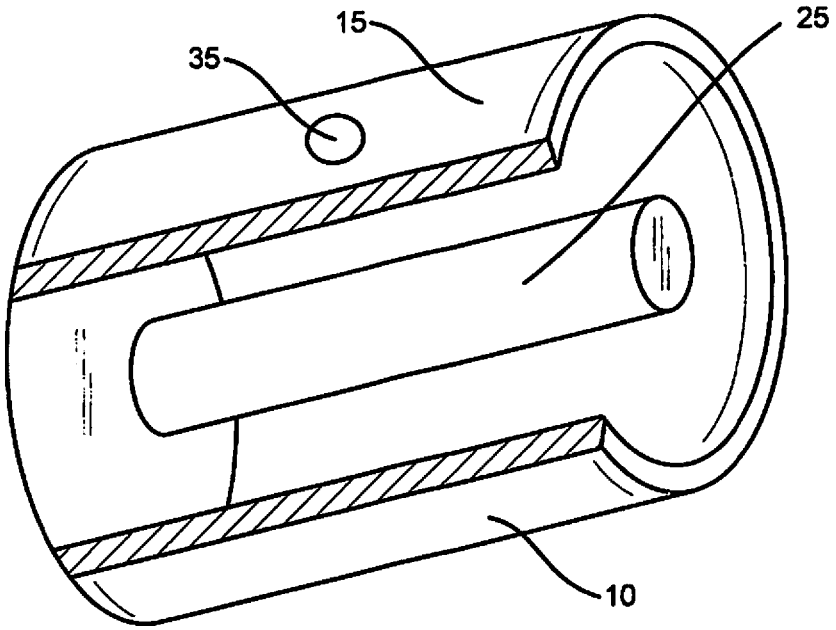
FIG. 3 is a cut away elongate view of an inside of the controlled moisture wet wipe toilet paper roll device in accordance with an embodiment of the present disclosure.

FIG. 3 is a cut away elongate view of an inside of the controlled moisture wet wipe toilet paper roll device in accordance with an embodiment of the present disclosure.

Similar reference numbers are used for similar features as illustrated in other figures for a shorter toilet paper roll. The paper roll egress is cut away to reveal details of the hollow tube 25.

Figure 4:
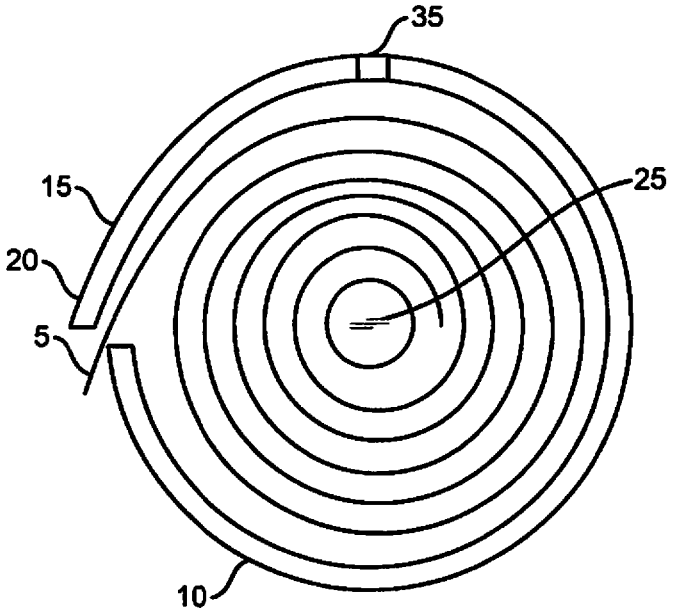
FIG. 4 is a cross-sectional view of the controlled moisture wet wipe paper towel roll device of FIG. 1 in accordance with an embodiment of the present disclosure.

FIG. 4 is a cross-sectional view of the controlled moisture wet wipe paper towel roll device of FIG. 1 in accordance with an embodiment of the present disclosure. Similar reference numbers are used for similar features as illustrated in other figures.

Figure 5:
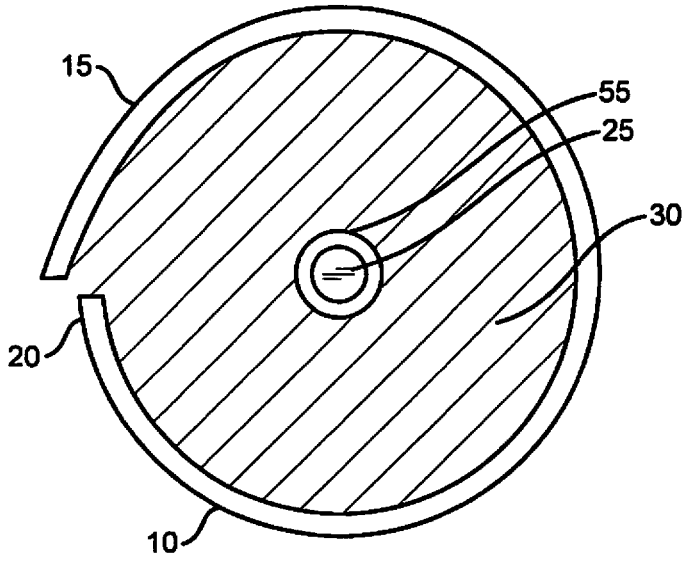
FIG. 5 is an end elevational view of a controlled moisture wet wipe roll device in accordance with an embodiment of the present disclosure.

FIG. 5 is an end elevational view of a controlled moisture wet wipe roll device in accordance with an embodiment of the present disclosure. Similar reference numbers are used for similar features as illustrated in other figures herein.

A wet wipe device is disclosed to include a water tight outer shell comprising two endcaps, at least one moisture inlet and an overlapping longitudinal paper egress defined in the outer shell. The device also includes a hollow tube disposed radially within the outer shell, the hollow tube configured to enable the roll of paper to rotate thereon while the outer shell is stationary. The overlapping longitudinal paper egress includes a first edge having a first radius and a second edge having a radius less than the first radius to form an overlapping seal around the paper egress. The at least one moisture inlet includes one moisture inlet for a toilet paper roll shell and at least two moisture inlets for a paper towel shell.

Embodiments of the disclosure include the at least one moisture inlet configured as a self sealing inlet capable of admitting fluids via a dropper and via a bulb baster. A moisture wicking layer adjacent an inside of the outer shell is configured to distribute moisture to an outside layer of the paper roll adjacent the layer. A tongue and grove interface between the hollow tube and the endcaps configured to allow the rotation of the roll of paper while the outer shell is stationary. One endcap is fastened to the outer shell via a water tight snap seal to enable disassembly of the shell and an insertion of a new roll of paper.

A wet wipe system as disclosed, includes a continuous roll of paper, a water tight outer shell enclosing the roll of paper and comprising two endcaps, at least one moisture inlet and an overlapping longitudinal paper egress defined in the outer shell. A hollow tube is disposed radially within the outer shell. The hollow tube is configured to enable the continuous roll of paper to rotate thereon while the outer shell is stationary.

Embodiments are disclosed to include the roll of paper premoistened and premedicated for hemorrhoids and other personal hygiene issues. The roll of paper is a toilet roll and a paper towel roll. A paper cutter is configured to run in a track on the paper egress and cut the toilet paper or paper towel to a determined length for use.

A wet wipe method disclosed includes providing a roll of paper; inserting the roll of paper inside a water tight outer shell comprising two endcaps, at least one moisture inlet and an overlapping longitudinal paper egress defined in the outer shell; and rotating the roll of paper on a hollow tube disposed radially within the outer shell, the hollow tube configured to enable the roll of paper to rotate thereon while the outer shell is stationary. The wet wipe method disclosed further includes moisturizing the roll of paper to a predetermined moisture amount via inserting an amount of liquid through the moisture inlet.

Therefore, the present disclosure satisfies the long felt need for a modem spin on toilet paper and paper towels for improved hygiene and convenience and safety.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents included herein or by reference to a related application.

What is claimed is:

1. A wet wipe device comprising:

a water tight outer shell comprising two endcaps, at least one moisture inlet and an overlapping longitudinal paper egress defined in the outer shell; and a hollow tube disposed radially within the outer shell, the hollow tube configured to enable the roll of paper to rotate thereon while the outer shell is stationary.

2. The wet wipe device of claim 1, wherein the overlapping longitudinal paper egress comprises a first edge having a first radius and a second edge having a radius less than the first radius to form an overlapping seal around the paper egress.

3. The wet wipe device of claim 1, wherein the at least one moisture inlet comprises one moisture inlet for a toilet paper roll shell and at least two moisture inlets for a paper towel shell.

4. The wet wipe device of claim 1, wherein the at least one moisture inlet is a self sealing inlet capable of admitting fluids via a dropper and via a bulb baster.

5. The wet wipe device of claim 1, further comprising a moisture wicking layer adjacent an inside of the outer shell, the moisture wicking layer configured to distribute moisture to an outside layer of the paper roll adjacent the layer.

6. The wet wipe device of claim 1, further comprising a tongue and grove interface between the hollow tube and the endcaps configured to allow the rotation of the roll of paper while the outer shell is stationary.

7. The wet wipe device of claim 1, wherein one endcap is fastened to the outer shell via a water tight snap seal to enable disassembly of the shell and an insertion of a new roll of paper.

8. A wet wipe system comprising:

a roll of paper;

a water tight outer shell enclosing the roll of paper and comprising two endcaps, at least one moisture inlet and an overlapping longitudinal paper egress defined in the outer shell; and a hollow tube disposed radially within the outer shell, the hollow tube configured to enable the roll of paper to rotate thereon while the outer shell is stationary.

9. The wet wipe system of claim 8, wherein the roll of paper is premoistened.

10. The wet wipe system of claim 8, wherein the roll of paper is premedicated.

11. The wet wipe system of claim 8, wherein the roll of paper is a toilet roll.

12. The wet wipe system of claim 8, wherein the roll of paper is a paper towel roll.

13. The wet wipe system of claim 8, wherein the overlapping longitudinal paper egress comprises a first edge having a first radius and a second edge having a radius less than the first radius to form an overlapping seal around the paper egress.

14. The wet wipe system of claim 8, wherein the at least one moisture inlet comprises one moisture inlet for a toilet paper roll shell and at least two moisture inlets for a paper towel shell.

15. The wet wipe system of claim 8, wherein the at least one moisture inlet is a self sealing inlet capable of admitting fluids via a dropper and via a bulb baster.

16. The wet wipe system of claim 8, further comprising a moisture wicking layer adjacent an inside of the outer shell, the moisture wicking layer configured to distribute moisture to an outside layer of the paper roll adjacent the layer.

17. The wet wipe system of claim 8, further comprising a tongue and grove interface between the hollow tube and the endcaps configured to allow the rotation of the roll of paper while the outer shell is stationary.

18. The wet wipe system of claim 8 further comprising a cutter configured to run in a track on the paper egress and cut the paper to a determined length for use.

19. A wet wipe method, the method comprising:

providing a roll of paper;

inserting the roll of paper inside a water tight outer shell comprising two endcaps, at least one moisture inlet and an overlapping longitudinal paper egress defined in the outer shell; and rotating the roll of paper on a hollow tube disposed radially within the outer shell, the hollow tube configured to enable the roll of paper to rotate thereon while the outer shell is stationary.

20. The wet wipe method of claim 19, further comprising moisturizing the roll of paper to a predetermined moisture amount via inserting an amount of liquid through the moisture inlet.

* * * * *